US005217546A

United States Patent [19]

Eady et al.

[11] Patent Number: 5,217,546

[45] Date of Patent: Jun. 8, 1993

[54] CAST ALUMINIUM ALLOYS AND METHOD

[75] Inventors: John A. Eady; Christopher J. Heathcock, both of Victoria, Australia; Peter L. Kean, Worcester, United Kingdom; Kevin P. Rogers, Victoria, Australia; Rodney A. Legge, Gloucester, United Kingdom

[73] Assignee: Comalco Aluminum Limited, Melbourne, Australia

[21] Appl. No.: 887,395

[22] Filed: May 21, 1992

Related U.S. Application Data

[63] Continuation of Ser. No. 536,615, filed as PCT/AU89/0054, Feb. 10, 1989, published as WO 89/07662, Aug. 24, 1989, abandoned.

[30] Foreign Application Priority Data

Feb. 10, 1988 [AU] Australia ..... PI6681

[51] Int. Cl.[5] ..... C22F 1/04

[52] U.S. Cl. ..... 148/549; 148/417; 148/439; 420/535; 420/544; 420/549

[58] Field of Search ..... 148/549, 417, 439; 420/535, 544, 549

[56] References Cited

U.S. PATENT DOCUMENTS

| | | | |
|---|---|---|---|
| 4,068,645 | 1/1978 | Jenkinson | 148/404 |
| 4,434,014 | 2/1984 | Smith | 148/417 |
| 4,786,340 | 11/1988 | Ogawa et al. | 148/439 |

FOREIGN PATENT DOCUMENTS

| | | |
|---|---|---|
| B1-86630/75 | 5/1977 | Australia . |
| B-14635/76 | 12/1977 | Australia . |
| B-75005/81 | 3/1982 | Australia . |
| 0170963 | 2/1986 | European Pat. Off. . |
| 1932537 | 2/1970 | Fed. Rep. of Germany . |

OTHER PUBLICATIONS

Chemical and Physical Characteristics of Molten Aluminum, Chapter 3, Aluminum Casting Technology, American Foundryman's Society Inc., 1986, pp. 28–30.

ASM Metals Handbook, vol. 15, Castings, 9th Edition, 1988, pp. 751–752.

ASM Metals Handbook, vol. 15, Castings, 9th Edition, 1988, p. 164.

P. Davami, et al., Strontium as a Modifying Agent for Al-Si Eutectic Alloy, British Foundryman, 72(4), 1979, pp. 4–7

B. Closset, et al., A356.0 Alloys Modified with Pure Strontium, AFS Transactions, 1982, pp. 453–464.

J. E. Gruzleski, et al., Strontium Addition to Al-Si Alloy Melts, Proceedings of Conference on Solidification Processing, Sheffield University, 1987, pp. 52–54.

*Primary Examiner*—R. Dean
*Assistant Examiner*—Robert R. Koehler
*Attorney, Agent, or Firm*—Larson & Taylor

[57] ABSTRACT

A cast hypereutectic Al-Si alloy with from 12–15% Si, having excellent wear resistance and machinability, improved fatigue strength and good levels of ambient and elevated temperature properties is provided, as well as a method of producing such alloy. The alloy and a melt used in the method contains Sr in excess of 0.10% and Ti in excess of 0.005%, the alloy further comprising: Cu 1.5 to 5.5%, Ni 1.0 to 3.00%, Mg 0.1 to 1.0%, Fe 0.1 to 1.0%, Mn 0.1 to 0.8%, Zr 0.01 to 0.1%, Zn 0 to 3.0%, Sn 0 to 0.2%, Pb 0 to 0.2%, Cr 0 to 0.1%, Na 0 to 0.01%, B (elemental) 0.05% maximum, Ca 0.003% maximum, P 0.003% maximum. Others 0.05 maximum each, the balance, apart from incidental impurities, being Al. The level of Sr in excess of 0.10% and Ti in excess of 0.005% in such that the alloy has a microstructure in which any primary Si formed is subatntially uniformly dispersed and is substantially free of segregation, and in which substantially uniformly dispersed Sr intermetallic particles are present but are substantially free of such particles in the form of platelets, with the microstructure predominantly comprising a eutectic matrix.

29 Claims, 20 Drawing Sheets

FIG. 1(a)
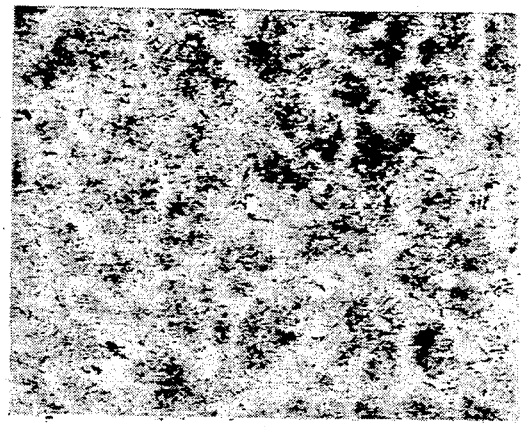
50x
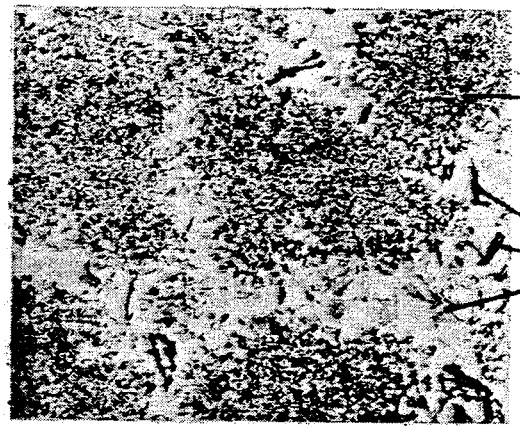
200x
FIG. 1(b)

FIG. 2(a)
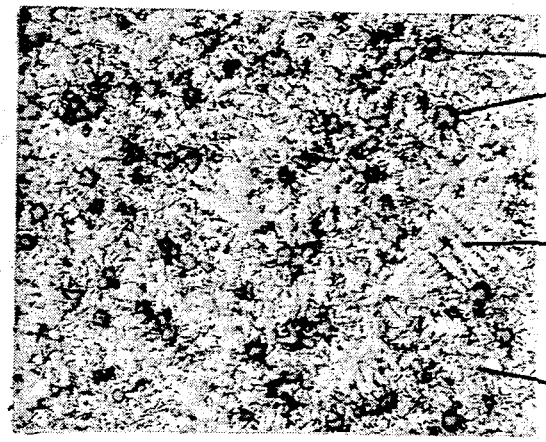
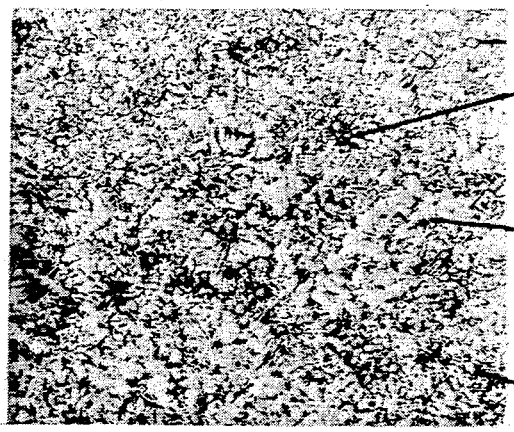
FIG. 2(b)

TOP

MIDDLE

BOTTOM x 13 x 60

FIG. 9(a)
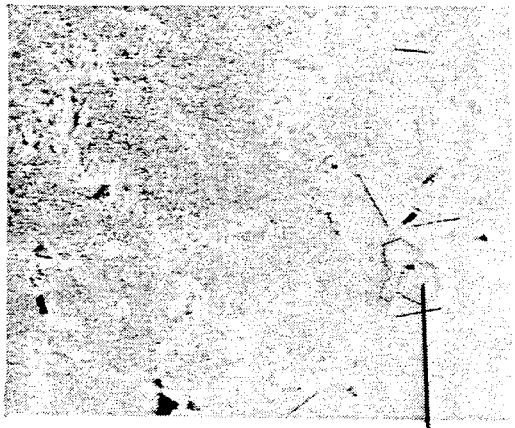
x50
PRIMARY Si
PARTICLE
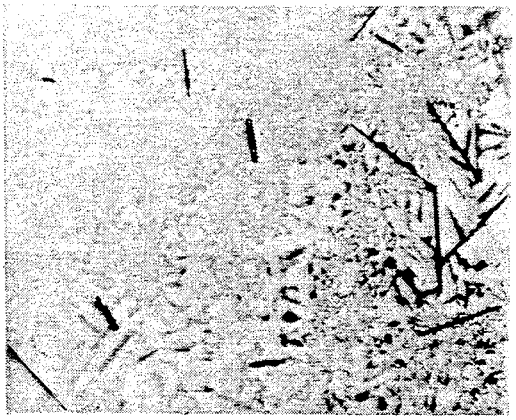
x200
FIG. 9(b)

x 50 x200

Fatigue Life

Rotating Beam

3HA WITH NORMAL (0.003%) Na (50x)

3HA WITH EXCESSIVE (0.05%) Na (50x)

G and R ranges for conventional old 3HA

Estimated expansion in G and R values for modified 3HA of the current invention

CAST ALUMINIUM ALLOYS AND METHOD

This application is a continuation of application Ser. No. 07/536,615 filed as PCT/AU89/0054, Feb. 10, 1989, published as WO 89/07662, Aug. 24, 1989, now abandoned.

This invention relates to high strength, wear resistant Al-Si alloys of improved castability, and to a method of improving the castability of such alloys. The alloys of the invention are suitable for complex permanent mould castings and sand castings in which it generally is difficult to avoid the formation of excessive primary Si. The invention provides simple to utilise chemical means for controlling the formation of primary Si in such castings.

We previously have proposed an Al-(11-20%)Si alloy (herein referred to as the Jenkinson alloy), which has preferred additions of at least one of Cu and Mg, and modified by at least one of Sr and Na. The Jenkinson alloy is the subject of Australian patent 475116 and corresponding patents in other countries comprising:

| | |
|---|---|
| British | 1437144 |
| Canadian | 1017601 |
| French | 2225534 |
| Japanese | 50116313 |
| Swedish | 7468645 |
| United States | 4068645 |
| West Germany | 2418389 |

The Jenkinson alloy more specifically has the composition by weight:

| | |
|---|---|
| Si | 11-20% |
| Mg | 0-4% |
| Cu | 0-4% |
| Fe | 0-1.5% |
| Sr | 0-0.10% |
| Na | 0-0.10% |

the balance, apart from unavoidable impurities, being Al. In forming the Jenkinson alloy, a melt of that composition is allowed to solidify under conditions such that the growth rate R of the solid phase is 10 to 5000 microns/sec and the temperature gradient G at the solid/liquid interface is from 100° C./cm to 500° C./cm. Such solidification conditions are controlled to produce the Jenkinson alloy with a microstructure that is virtually free from primary Al or Si phases, containing not less than 90% Al/Si eutectic phases where the Si is in the form of eutectic particles of less than 10 microns in diameter, and preferably less than 1 micron diameter.

With the hypereutectic Jenkinson alloy, the eutectic coupled growth concept was proposed to achieve a fully modified eutectic structure. Such a structure can be achieved under the above-indicated, strictly controlled solidification conditions, such as in a laboratory solidification rig or in very simple castings. However, it has proved to be impossible to obtain structures substantially free from primary Si in complex castings (such as cylinder heads and engine blocks) produced with that alloy by conventional casting techniques As will be appreciated, the presence of primary Si greatly reduces the properties of the alloy, especially machinability and fatigue resistance.

As a consequence of its extremely difficult casting characteristics, the Jenkinson alloy has not been able to be successfully applied in the production of such complex engine parts.

Subsequent to the development of the Jenkinson alloy, we have further proposed a complex Al-Si alloy with a lower Si range of 12-15% (referred to herein as 3HA alloy). Our 3HA alloy is the subject of Australian patent 536976 and corresponding patent protection in other countries comprising:

| | |
|---|---|
| British | 2085920 |
| Canadian | 1175867 |
| French | 2489846 |
| Japanese | 62011063 |
| New Zealand | 198294 |
| Swedish | 454446 |
| United States | 4434014 |
| West Germany | 3135943 |

Our 3HA alloy has the following composition by weight:

| | |
|---|---|
| Si | 12-15% |
| Cu | 1.5-5.5% |
| Ni | 1.0-3.0% |
| Mg | 0.1-1.0% |
| Fe | 0.1-1.0% |
| Mn | 0.1-0.8% |
| Zr | 0.01-0.1% |
| Si modifier | 0.001-0.1% |
| Ti | 0.01-0.1% |

the balance, apart from impurities, being Al. The proposal for the 3HA alloy, as provided in said Australian patent 536976 and counterparts in other countries, typically entails preparation by establishing a melt of that composition and allowing the melt to solidify under conditions such that during solidification R is from 150 to 1000 microns/sec and G is such that the ratio G/R is from 500° to 8000 °Cs/cm$^2$.

The 3HA alloy is much improved, compared with the Jenkinson alloy, in respect of its foundry, tribological and mechanical properties. The 3HA alloy can be cast successfully by high pressure die casting operations for both simple and complex casting shapes and such casting operations are suitable for use on a production basis for that alloy. The 3HA alloy also can be cast successfully on a production basis in sand and permanent moulds, and castings having good properties can be produced. However, casting of the 3HA alloy in sand or permanent moulds on a production basis essentially is limited to castings of relatively simple shapes, such as cylindrical components. With more complex castings produced in sand or permanent moulds, tight controls are necessary to avoid excessive formation of primary Si, typically as large particles. While such formation of primary Si is detrimental in itself, it also depletes the matrix of Si, resulting in the matrix featuring large areas of alpha-aluminium in dendrite form together with Al-Si eutectic. The detrimental effects of primary Si and related features in the 3HA alloy results in a large reduction in machinability, fatigue strength and wear resistance.

The structure of 3HA alloys can be improved in complex castings by the judicious application of cooling/heating in permanent moulds or of chills in sand moulds. However these techniques can be costly in the high volume production of complex castings such as engine blocks and cylinder heads. Consequently, the problem of structure control limits the practical utility of the 3HA alloy, despite the highly desirable characteristics able to be obtained with that alloy in simple castings or those produced by high pressure die casting.

The present invention is directed to overcoming the foregoing problems by providing an improved method of casting hypereutectic Al-Si alloys. The invention is particularly concerned with achieving alloys of the 3HA type which have improved castability and provides techniques particularly useful in the production of hypereutectic aluminium alloys having from 12 to 15% Si, with all compositions herein being on the basis of percent by weight. The alloys of the present invention may be broadly such as disclosed in our Australian patent specification 536976 and its counterparts in other countries, subject to qualifications specified herein, but are not limited to the alloys of that specification.

The invention comprises the addition to the Al/Si alloys of abnormally high levels of strontium, compared with those conventionally used, in combination with titanium.

Hypoeutectic Al-Si foundry alloys (containing less than 12.7% Si) commonly use very low levels of modifier such as Sr (0.03%) to refine and round the eutectic Si particles. In hypereutectic alloys (containing greater than 12.7% Si) the use of modifiers such as Sr up to 0.1% has been proposed to extend the coupled zone and thus extend the Si content of the alloys over which substantially eutectic microstructures can be achieved, such as disclosed in said specification 536976.

Prior to the present invention, however, modifiers have been used at these quite low levels to avoid adverse effects. In the case of Sr, the level is below 0.10%, as an intermetallic compound, detrimental to mechanical properties, forms beyond 0.10%. Particles of the intermetallic compound form as platelets which create points of weakness in the microstructure, resulting in a reduction in strength and fatigue resistance. Again in the case of Sr as the modifier, this is illustrated by the reports of G. K. Sigworth, Research Report 83-12 Nov., 1982, Cabot Corporation, P.O. Box 1462, Reading Pa., 19603 and B. Closset and J. E. Gruzleski, AFS Transactions, 82/31, pages 453–464.

In the Al-(12–15%) Si alloys of the present invention which are more fully detailed below, we have found that, surprisingly, the use of Sr at a level in excess of 0.1% achieves very beneficial effects. Specifically, we have found that when Sr is added to the alloys of the invention in excess of 0.10%, it does not widen the coupled zone sufficiently to eliminate the presence of primary Si particles in complex castings but instead it substantially prevents those primary Si particles that do form from floating. This is an unexpected result.

The beneficial effects of the level of Ti in the high Sr containing Al-(12–15%) Si alloys of the present invention are also unexpected. Levels of Ti (0.03–0.05%) are commonly used in aluminium foundry alloys as a grain refiner, providing nucleating sites for primary aluminium. In the present invention, however, we have found that the addition of Ti at a level in excess of 0.005% to the high Sr-containing alloy has other, unexpected, beneficial effects.

Specifically, Ti in excess of 0.005% has been found to provide a first beneficial effect in further suppressing the formation of primary Si particles, but only in the high Sr-containing alloys.

Moreover, we have found that the use of Ti in the alloys according to the invention achieves a second beneficial effect. This effect is of preventing the formation of detrimental Sr intermetallic platelets which would be expected to result with use of Sr at a level in excess of 0.10%. While Sr intermetallic particles still are formed, the use of Ti in excess of 0.005% according to the invention is found to result in those particles being present in a substantially equi-axial, blocky form. That is, the Ti in this case is found to change the morphology of the Sr intermetallic particles. The combined result of Sr at a level in excess of 0.10% and Ti at a level in excess of 0.005% can be such that the alloy according to the invention can be substantially free of primary Si particles, while flotation of such particles as do form is substantially prevented.

The Ti most preferably is added as AlTiB without excess boron, or as AlTi master alloy, which contains or provides at least one compound such as $(Al,Ti)B_2$, $TiB_2$ and $TiAl_3$. Also, other similar compounds such as TiC and TiN can achieve the same effects as the above compounds. In each case, the addition of at least one of the Ti compounds is such as to achieve a Ti level in excess of 0.005%. Whenever a Ti addition is referred to hereafter it should be read as indicating the addition of at least one of the above compounds unless specified otherwise.

Thus, according to the present invention, there is provided a method of producing a casting of a hypereutectic Al-Si alloy having 12–15% Si, comprising:

(a) providing a melt of the alloy with Sr present at a level in excess of 0.10% together with Ti present, as described above, at a level in excess of 0.005%, the melt further comprising:

| | |
|---|---|
| Cu | 1.5 to 5.5% |
| Ni | 1.0 to 3.0% |
| Mg | 0.1 to 1.0% |
| Fe | 0.1 to 1.0% |
| Mn | 0.1 to 0.8% |
| Zr | 0.01 to 0.1% |
| Zn | 0 to 3.0% |
| Sn | 0 to 0.2% |
| Pb | 0 to 0.2% |
| Cr | 0 to 0.1% |
| Na | 0 to 0.01% |
| B(elemental) | 0.05% maximum |
| Ca | 0.003% maximum |
| P | 0.003% maximum |
| Others | 0.05% maximum each, |

the balance, apart from incidental impurities, being Al; and (b) casting the melt in a mould substantially without melt loss of Sr to form the casting;

the level of Sr in excess of 0.10% and Ti in excess of 0.005% being appropriate for the solidification conditions experienced in terms of mould type and the complexity of the casting, such that the melt has improved castability resulting in a microstructure in which any primary Si present is substantially uniformly dispersed and is substantially free of segregation, and in which substantially uniformly dispersed Sr intermetallic particles are present but are substantially free of such particles in the form of platelets, the microstructure predominantly comprising a eutectic matrix.

The invention also provides a cast hypereutectic Al-Si alloy with from 12–15% Si, the alloy having good wear resistance and machinability, improved fatigue strength and good levels of ambient and elevated temperature properties; wherein said alloy contains Sr in excess of 0.10% together with Ti in excess of 0.005%, the alloy further comprising:

| | |
|---|---|
| Cu | 1.5 to 5.5% |
| Ni | 1.0 to 3.0% |

-continued

| | |
|---|---|
| Mg | 0.1 to 1.0% |
| Fe | 0.1 to 1.0% |
| Mn | 0.1 to 0.8% |
| Zr | 0.01 to 0.1% |
| Zn | 0 to 3.0% |
| Sn | 0 to 0.2% |
| Pb | 0 to 0.2% |
| Cr | 0 to 0.1% |
| Na | 0 to 0.01% |
| B(elemental) | 0.05% maximum |
| Ca | 0.003% maximum |
| P | 0.003% maximum |
| Others | 0.05% maximum each, |

the balance, apart from incidental impurities, being Al; and wherein the level of Sr in excess of 0.10% and Ti in excess of 0.005% is such that the alloy has a microstructure in which any primary Si present is substantially uniformly dispersed and is substantially free of segregation, and in which substantially uniformly dispersed Sr intermetallic particles are present but are substantially free of such particles in the form of platelets, the microstructure predominantly comprising a eutectic matrix.

In summary, the present invention is based on the combination of unexpected discoveries that beneficial results can be achieved in Al-(12–15%) Si alloys by the use of levels of Sr in excess of 0.10% in conjunction with Ti in excess of 0.005%. The resulting satisfactory microstructure is therefore achieved through chemical means, whereas previously the same results have been sought to be achieved by closely controlled solidification techniques, including close controls on metal and die temperatures. In such case, the precise closely controlled solidification techniques, as previously have been attempted, have also been dictated by the increasing complexity in castings. In other words, special solidification conditions were needed for each different complex casting.

The use of Sr in excess of 0.10%, in combination with Ti in excess of 0.005% as specified, provides the ability to substantially increase the utility of hypereutectic aluminium alloys having from 12–15% Si in the commercial production of castings. That is, by appropriate use of that combination of Sr and Ti, it becomes possible to produce castings in which both primary Si is suppressed and formation of Sr intermetallic platelets virtually eliminated. However, the extent to which suppression of primary Si is necessary varies with the variability in solidification conditions, and hence the complexity of casting. Also the tendency for primary Si to be formed is greater for a given casting made in a sand mould compared with a permanent mould. However, each of these matters can be compensated for by appropriate adjustment of the lower level of Sr addition in excess of 0.1%, and with corresponding additions of Ti for further control of primary Si and control of Sr intermetallics.

According to the present invention a level of Sr only slightly in excess of 0.10% generally is suitable only for relatively simple or thin wall section castings produced in a permanent mould. Generally Sr is present at a level of at least 0.11% and this is suitable for castings of a lower degree of complexity or of relatively thin wall section produced in a permanent mould or for relatively simple or thin wall section castings produced in a sand mould. The level of Sr need not exceed 0.4%, as additions of Sr above 0.4% are found not to achieve any beneficial increase in respect of suppressing formation of primary Si and thus simply increase the tendency for the formation, and difficulty in control, of Sr intermetallics. Depending on the complexity of the casting or its wall section thickness as referred to earlier, a typical range of Sr addition is from 0.11 to 0.4%, with 0.15 to 0.4% being preferred. Sr at a level of 0.18 to 0.4% is more preferred, with 0.25 to 0.35% being most preferred.

As indicated, according to the present invention, the level of Ti required in the high Sr-containing alloy is in excess of 0.005%. When Ti is added as Al-Ti-B master alloy, the Ti level should preferably not exceed 0.1% Ti since, above this level, it has a negative consequence and appears to increase primary Si formation. When Ti is added in forms other than as Al-Ti-B master alloy, the optimum level can be different and for example, with $TiAl_3$ as in Al-Ti master alloy, the Ti level preferably should not exceed 0.25%. The level of Ti required is dictated in part by, and generally increases with, the level of Sr in excess of 0.10%. Preferably Ti is provided at a level of 0.01% to 0.06%, most preferably from 0.02% to 0.06%, such as from 0.03% to 0.05%.

The Ti compounds can be added in different forms and ways including master alloy as waffle, briquettes, rod or powder or as individual compounds in powder form. The powders can be added by flux injection techniques.

The use of Sr at a level in excess of 0.10%, in addition to reducing the number, and preventing flotation, of primary Si particles, can also provide the known modifier effects in the alloys of the present invention. That is, the Sr can modify (refine and round) the shape of the eutectic Si particles and extend the Si content of the alloys with substantially fully eutectic microstructures. Despite this, the alloys of the invention if required, also can include Na, a known modifier for this latter purpose. However, such known modifier, if present, is used within its normal range of up to 0.01%, and is additional to the use of Sr at a level in excess of 0.10%. Excess levels of Na by itself will not have the desired effect.

In the foregoing, the alloy and method of casting, according to the present invention, have been defined in terms of its Si, Sr and Ti content, as well as other alloying additions present. The additions of Cu, Ni, Mg, Fe, Mn and Zr are to provide strengthening and hardening intermetallic compounds.

In addition to the above specified elements, the melt and alloy of the invention can include Zn, Sn, Pb and Cr. These elements, in general, do not confer a significant beneficial effect but also do not have adverse consequences where used below the respective limits specified above; although, if present, they should not exceed those limits to avoid adverse consequences.

While Zn, Sn, Pb and Cr do not achieve a significant beneficial effect, it is necessary that each of these be considered. The principal reason for this is that these elements can be present in secondary alloys according to the invention produced from or including scrap material Other elements can be present and, in general, these preferably do not exceed 0.05% each. An exception to this exists in the case of each of Ca and P, as these adversely affect modification of the eutectic of the microstructure, and each of Ca and P preferably is at a level not exceeding 0.003%.

In our above-mentioned Australian patent specification 536976 and its counterparts in other countries, the process disclosed therein for the production of alloy 3HA entails the use of specific cooling conditions, comprising solidification of a melt of the alloy such that:

(a) the growth rate R of the solid phase during solidification is from 150 to 1000 microns per second; and (b) the temperature gradient G at the solid/liquid interface, expressed in ° C./cm, is such that the ratio G/R is from 500 to 8000° Cs/cm$^2$.

The present invention can be used in combination with this process to enable the problem of formation and floating of such large primary Si particles to be overcome even more positively. Thus, in one preferred form of the present invention, there is provided an improved type of alloy 3HA, and such process for its production based on such specific cooling conditions. The entire disclosure of said specification 536,976 is by this cross-reference hereby incorporated into, and therefore to be read as part of, the present specification.

In such preferred form of the present invention, the higher levels of Sr with Ti again reduce the number, and substantially prevent flotation, of the primary Si particles. This preferred form can, of course, be used with other than relatively complex castings. However its application principally is in relation to such complex castings in which it is otherwise virtually impossible to eliminate primary Si particles and if they occur, their flotation, because of the variation in solidification conditions that can occur in such castings, for example when there is a combination of very thin and very thick sections.

In the above description of a preferred form of the invention, reference is made to an improved type of alloy 3HA, rather than simply to alloy 3HA per se as disclosed in said specification 536976. This in part reflects the change in composition attributable to the higher level of Sr used, while it also reflects the possible use of a modifier other than, but in addition to, Sr. Furthermore, the Ti content can vary, while B can be present, as detailed herein. Also, allowance is made for optional alloy additions and control over the level of Ca and P.

At a level of Sr of 0.10%, or lower, it is difficult to control the formation, and prevent flotation, of primary Si particles. Also, as indicated, at levels above 0.4%, Sr is found not to achieve an additional benefit Rather, use of greater than 0.4% Sr increases cost and makes more difficult the suppression of formation of Sr intermetallic particles as platelets. At or below 0.005%Ti, Ti is found not to achieve a useful effect in further reducing the amount of primary Si and in suppressing formation of those intermetallic particles as platelets. Above the respective limits for Ti of 0.1% when added as Al-Ti-B master alloy and 0.25% when added as Al-Ti master alloy for $TiAl_3$ or other forms, Ti is found not to achieve an additional benefit in changing intermetallic morphology but has a tendency to increase primary Si formation.

In the case of the alloying elements Cu, Ni, Mg, Fe, Mn and Zr, the composition of the alloy requires the careful selection of these alloying elements and the correct proportions of each to achieve optimum benefit. In most cases the effect of one element depends on others and hence there is an interdependence of the elements within the composition. In general, levels of these alloying elements above the maxima specified for the alloys of the invention give rise to excessively coarse primary intermetallics. Levels below the minima specified in general do not achieve the practical useful effect detailed in the following.

In the alloys of the invention, Cu, Ni, Mg, Fe, Mn and Zr provide intermetallic compounds which form part of the eutectic microstructure and are based principally on the Al-Si-Cu-Ni system. The eutectic intermetallic particles are principally silicon but Cu-Ni-Al, Cu-Fe-Ni-Al and other complex intermetallic phases also may be present. Naturally, as particle size increases so does the propensity for cracking under applied loads. For this reason the intermetallic particles comprising the eutectic must be fine (less than 10 microns in diameter), preferably uniformly dispersed and preferably with an interparticle spacing not greater than 5 microns.

In addition to the eutectic intermetallic particles, the alloys of the invention comprise a dispersion of intermetallic precipitates within the alpha aluminium phase of the eutectic. Such dispersion reinforces the matrix and helps the loads to be transmitted to the eutectic particles and increases the ability for load sharing if any one eutectic Particle cracks. In the present alloys we believe that the elements Mg and Cu are responsible for strengthening the matrix by precipitation hardening and/or the formation of solid solutions. The Cu to Mg ratios are preferably within the limits of 3:1 to 8:1. Below this ratio unfavourable precipitates may form. Cu levels beyond the specified limits may reduce the corrosion resistance of the alloy in some applications.

Strengthening is further enhanced by the presence of stable Mn and/or Zr containing dispersed particles. We also include these elements to improve high temperature resistance.

Ni, Fe and Mn are particularly effective for improving elevated temperature properties and form a number of compounds with each other. These elements are interchangeable to a certain degree as shown below:

$$0.2Fe+Mn<1.5$$

$$1.1Fe+Ni<3.0$$

$$1.2Fe+Ni+Mn<4.0$$

Alloys of the invention may therefore be primary alloys with the lower Fe content or secondary alloys where the Fe levels may reach the maximum of the specification. The Mn and Ni content must be adjusted accordingly.

Titanium is a well known grain refiner and as a result can improve the mechanical properties of the alloy, in addition to its role detailed herein in further decreasing the number of primary Si particles formed and in changing the morphology of any Sr intermetallic particles so that platelets are not formed.

While the alloys of the present invention have excellent properties in the as-cast condition, the compositions are such that most properties can be improved by heat treatment. It is understood, however, that heat treatment is optional. For example the cast alloy may be directly subjected to a stabilising artificial ageing treatment at 160°-220° C. for 2-16 hours.

A variety of other heat treatment schedules may be employed and may include solution treatment at 480°-530° C. for 5-20 hours. These solution treatments are selected to provide a suitably supersaturated solution of elements in Al, whilst still avoiding unacceptable growth of the strengthening intermetallic particles so that a preferred dispersion of eutectic particles remains, i.e. a microstructure in which the eutectic particles are less than 10 microns in diameter, preferably equiaxed, preferably uniformly dispersed and preferably with an interparticle spacing not greater than 5 microns.

The solution treatment may be followed, after quenching, by artificial ageing at 140°-250° C. for 2-30 hours. A typical heat treatment schedule may be as follows:

8 hours at 500° C.;
quench into hot water;
artifically age at 160° C. for 16 hours.

In the above description of preferred forms of the invention, used in combination with the process of specification 536976, reference is made to a growth rate R, and a temperature gradient G which attains a ratio G/R, having values "of the order of" the ranges of values disclosed in specification 536976. Those ranges can be used in setting the solidification conditions for that combination. However, the use of Sr at a level in excess of 0.10%, such as from 0.11% to 0.4%, in combination with Ti enables the solidification conditions to be relaxed, for example with lower growth rates or temperature gradients. The process for 3HA alloy as disclosed in said specification 536976 requires that the temperature gradient, G, be in the range of 7.5° C./cm to 8000° C./cm and the growth rate, R, be in the range of 150 microns/sec to 1000 microns/sec giving a G/R range of 500° to 8000° C.s/cm2 The alloy of the present invention is suitable for castings solidifying under temperature gradients of less than 7.5° C./cm and growth rates of less than 150 microns/sec. The lower limits for G and R applicable to the alloy of this invention are estimated to be close to 0° C./cm for G and as low as 15 microns/sec for R.

Thus with Al-(12-15%) Si alloys containing the required further additions of Sr in combination with Ti, according to the present invention, castings can be produced in which microstructures are controlled essentially by chemical means, allowing use of a significantly wider range of solidification conditions, and thereby eliminating the need for reliance on stringent control over solidification conditions. For example, castings with the desired microstructure can be produced using conventional sand moulds, even in the case of castings featuring pronounced varying section thicknesses.

In relation to the use of Ti; it is recognised that Ti and B are commonly used in Al-Si alloys, to which they are added in the form of Al-Ti-B alloy, to provide particles which act as nuclei for aluminium grains during solidification such that a finer grain structure is achieved. While most alloy specifications allow Ti levels up to 0.2%, in practice the levels normally are kept below 0.05% because excess $TiB_2$ can lead to castings having hard spots (clusters of $TiB_2$ particles). Such hard spots or clusters create machining problems. Unexpectedly, in the alloys of the present invention, such clusters are not present to any adverse extent. Boron levels are not usually specified in Al-Si alloys; rather they are determined by the B content of the Al-Ti-B alloying addition but generally do not exceed 0.05%.

Moreover, as detailed above, the use of Ti in excess of 0.005% in the high Sr-containing alloy, according to the invention, appears to act in a quite unexpected manner in both further reducing the number of primary Si particles formed and in preventing formation of Sr intermetallic platelets. That is, the conventional role of Ti is in nucleating Al grains. In contrast, in the present invention, the Ti discourages the formation of primary Si particles and changes the morphology of the Sr intermetallic particles, rather than just nucleating further, finer platelike particles. It is therefore not a simple case of Ti providing more nucleating sites for the Sr intermetallic platelets to form, but rather of some more complex mechanism operating which can discourage primary Si formation and change the crystallographic growth kinetics of the Sr intermetallic particles.

The Sr can be added or adjusted to a required level in excess of 0.10% in a melt to form an ingot of the alloy of the invention, or just prior to casting of products from a melt. The addition of Sr is possible in a melting furnace, a holding furnace or in a launder The Ti compounds, also can be added to a required level such that Ti is in excess of 0.005% at one or other of those stages.

The alloy of the invention is characterised by several beneficial properties. These are because of its special microstructure which is substantially free of primary silicon particles and those that are there do not float, and which contains substantially no Sr intermetallic platelets.

While the alloy of the invention has good machinability similar to that of the alloy of patent 536976 when the latter alloy is able to be cast to give the correct microstructure, the machinability of the alloy of the present invention is much more consistent as a consequence of its more consistent microstructure. This, of course, is in keeping with the control by chemical means over the formation of primary Si particles. However, it also is surprising given the increased level of Sr intermetallic particles resulting from the use of Sr in excess of 0.1%. According to the present invention, however, the Sr intermetallic particles present are in the form of roughly equiaxed, blocky, uniformly dispersed fine particles.

In alloys in which segregation of primary Si particles occur, for example when they are trapped under ledges after floating, such segregation typically is at a surface of a casting. The avoidance of such segregation is achieved in the alloy of the present invention and so further enhances its general good machinability. Thus, where it is required to machine, drill or tap a casting according to the invention, such action is facilitated by the uniform distribution, rather than segregation, of primary Si particles as may be present.

The alloy of the present invention exhibits significantly enhanced fatigue strength compared with the alloy of patent 536976. Also, while tensile strength can be slightly, but not significantly, reduced compared with the alloy of patent 536976, other physical properties such as hardness and resistance to wear are essentially the same as for the alloy of that patent.

Thus, overall, the alloy of the present invention, superior in that it is characterised by important improvements in castability, which provide consistent microstructures and hence excellent machinability and fatigue strength. These improvements enable more practical, high volume casting on a production basis, thereby extending the range of products able to be cast on such basis, and also achieving products having a wider range of practical utility.

In the foregoing, reference is made to alloys in which the microstructure is predominantly eutectic. It is to be noted that such microstructure can contain up to 10% of primary alpha-aluminium dendrites. We have found that dendrites to such level can be tolerated without excessive decrease in properties of the alloy. With progressive increase of other alloying additions producing intermetallic particles, the matrix exhibits eutectic cells bounded by such intermetallics, although the eutectic still predominates.

BRIEF DESCRIPTION OF THE DRAWINGS

Reference now is directed to the accompanying drawings, in which:

FIGS. 1(*a*) and (*b*) are photomicrographs showing the optimum microstructures for 3HA alloy according to patent 536976;

FIGS. 2(*a*) and (*b*) are photomicrographs showing typical poor microstructure for casting of a 3HA alloy according to patent 536976;

FIGS. 9(*a*) and (*b*) are photomicrographs of a casting according to the present invention;

FIGS. 1, 2 and 4, in their respective photomicrographs (a)×50 and (b)×100, illustrate clearly the constraints on the alloy and method disclosed in the Australian patent 536976. The photomicrographs are taken from castings made from a typical 3HA alloy according to that patent and containing Sr as the modifier at a level below 0.1% and cast under varying conditions. The G and R values for the casting in FIG. 1 would be in the ranges specified for these parameters for 3HA alloy, whereas the G and R values for the castings in FIGS. 2 and 4 would be below the lower limits specified for these parameters for 3HA alloy; specifically G would be in the range 1°–5° C./cm and R in the range 10–30 microns/sec. FIG. 1 shows an optimum structure of a relatively simple permanent mould casting of that typical alloy. FIGS. 2 and 4 show non-optimum structures respectively from a sand mould cast finned cylinder and an engine block of that typical alloy. Each of the castings of which the structure is shown in FIGS. 2 and 4 contains substantial numbers of large primary Si particles. In addition, since the formation of primary Si evident in FIGS. 2 and 4 has depleted the matrix of Si, the matrix in each case features large areas of alpha-aluminium in dendrite form and unmodified Al-Si eutectic.

In FIG. 3 there is provided a schematic representation of a section through the wall of the finned cylinder. Designation (a) and (b) of that representation show the regions at which the respective photomicrographs were taken. The cylinder was cast by pouring the 3HA alloy from the top, so as to progressively fill the mould. A relatively good microstructure was obtained at the bottom of the un-finned main wall section and at the outer extremity of the fins, due to the relatively rapid cooling obtained. However, the microstructure progressively deteriorated at higher levels of the main wall and at radially inner regions of the fins.

Figure 4A:
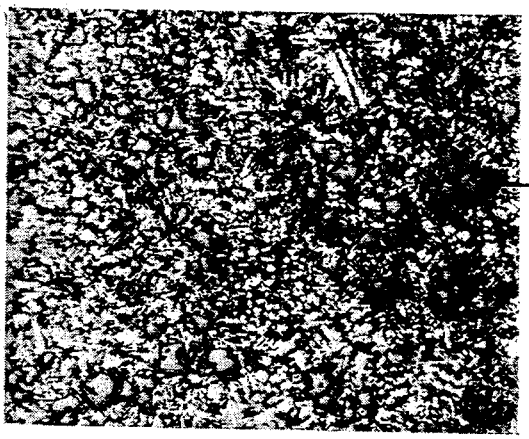
FIG. 4(*a*), (*b*) and (*c*) are photomicrographs showing typical poor microstructure for a further casting of a 3HA alloy according to patent 536976.
Figure 4B:
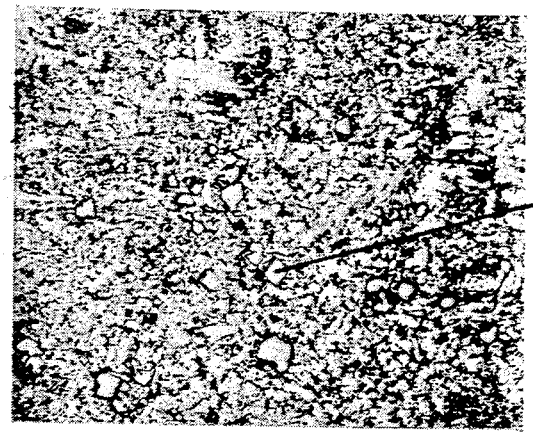
Figure 4C:
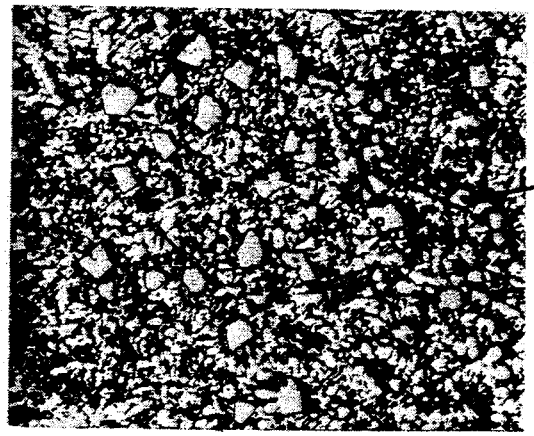

Similarly, adjacent to the photomicrographs (a) to (c) of FIG. 4, there is provided a wall-section representation of the engine block, with designations (a) to (c) of the representation having the same relevance. The engine block was cast in the orientation shown, with a melt flowing upwardly in the mould from below, after which the mould was inverted for solidification of the melt. Parts of the wall section thickness were such that a poor microstructure was obtained throughout the regions of the section.

Figure 6:
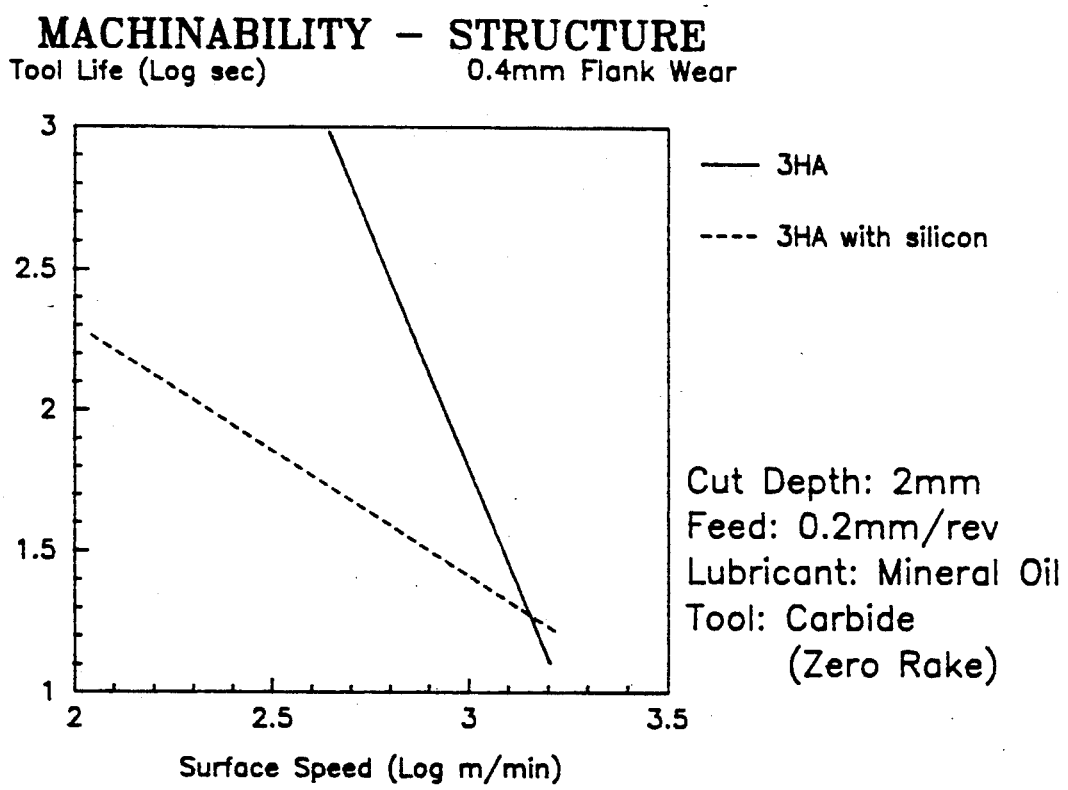
FIG. 6 is a graph illustrating the detrimental influence of primary Si on the machinability of 3HA alloy according to patent, 536976.
Figure 7:
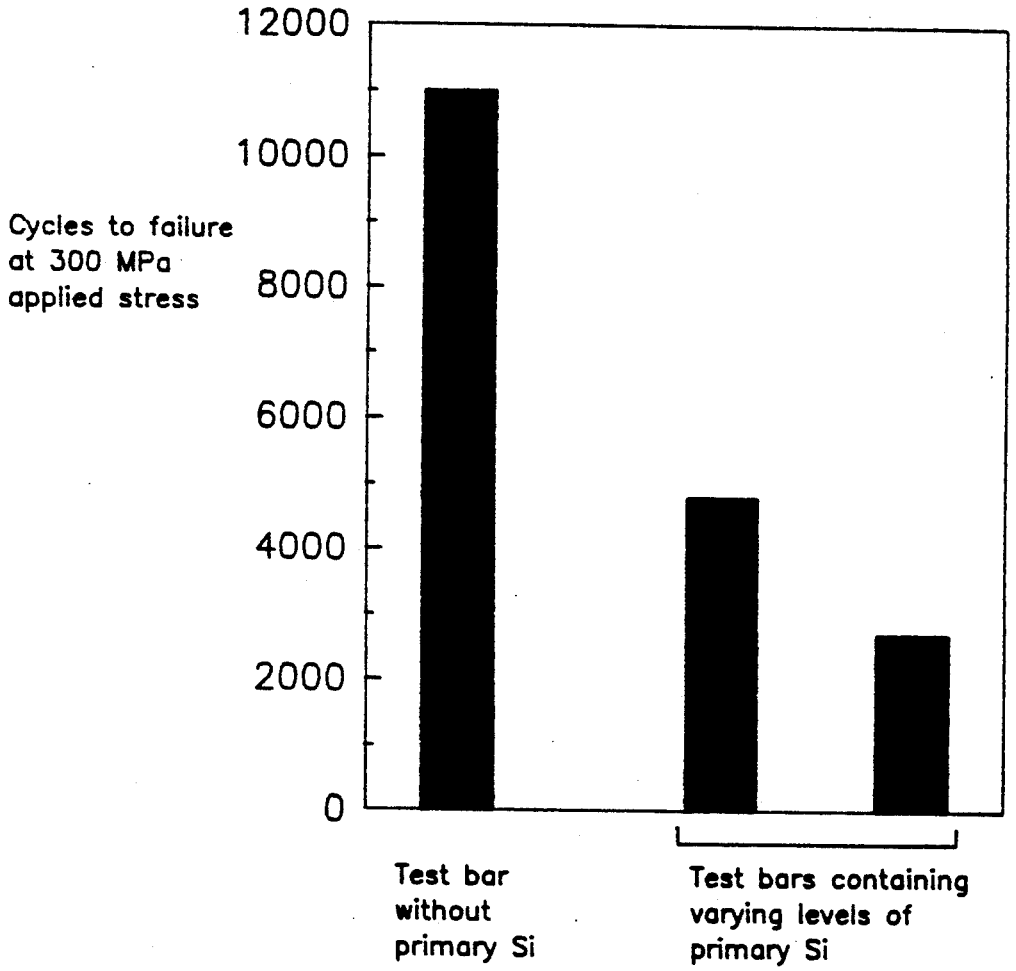
FIG. 7 is a bar chart representation illustrating the influence of primary Si on the fatigue strength of 3HA alloy according to patent 536976.

The detrimental effects of primary Si and related matrix features such as dendrites typified by the structures of FIGS. 2 and 4, are illustrated in FIGS. 6 and 7. In FIG. 4, tool life is plotted against the surface speed of cutting in machining a casting having a structure as in FIG. 1 (solid line) and a casting having a structure as in FIG. 2 or 4 (broken line). A very large reduction in machinability, as indicated by tool life, clearly is evident for the non-optimum structure due to the presence of primary Si, is contrasted with the optimum structure. At a typical practical cutting (surface) speed of 500 m/min (log value 2.69) tool life is nearly halved by the presence of substantial primary Si.

FIG. 7 shows the cycles to failure at 300 MPa applied stress for a test casting having an optimum structure as in FIG. 1, substantially free of primary Si, as contrasted with test castings having non-optimum structures as in FIG. 2 or 4 and respective levels of primary Si. In each case, the castings were cast under conditions attempting to provide a G/R ratio throughout the casting of from 1000° to 2000° Cs/cm$^2$. The low cycle fatigue data of FIG. 7 illustrates the dramatic reduction of fatigue strength attributable to primary Si. The importance of structure, including the presence or absence of primary Si, is further highlighted by Table 5 of Example 3 and Table 7 of Example 4 of patent specification 536976. Small deviations from optimum structure result in substantial reductions in resistance to compressive fatigue and sliding wear. Consistent microstructures, as can be achieved by the current invention are therefore crucial.

Figure 3:
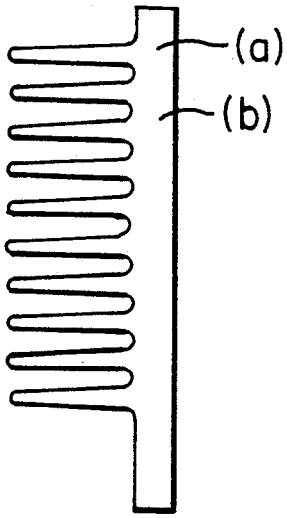
FIG. 3 is a schematic representation of a sectional view through the wall of a casting from which the photomicrographs of FIGS. 2(*a*) and (*b*) were taken.
Figure 5:
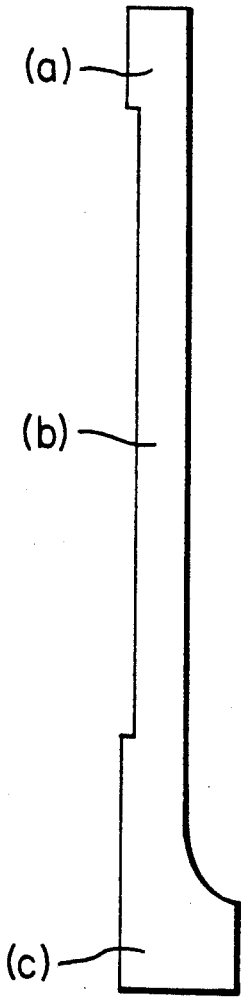
FIG. 5 is a schematic representation of a sectional view through the wall of a casting from which the photomicrographs of FIGS. 4(*a*), (*b*) and (*c*) were taken.

The structures illustrated in FIGS. 2 and 3 can be improved by controlling thermal gradients such as by judicious application of chills in the sand moulds. However, this is not a technique readily able to be used in a commercial operation to produce complex castings. Thus, such techniques make difficult the commercial foundry production of complex castings of 3HA alloy having a structure as in FIG. 1.

Figure 8A:
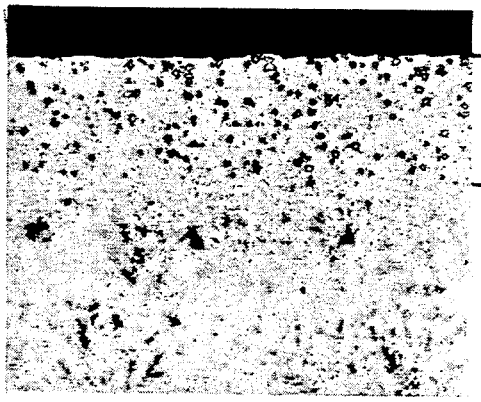
FIGS. 8(*a*) and (*b*) are photomicrographs of a casting produced from alloy 3HA according to patent 536976.
Figure 8B:
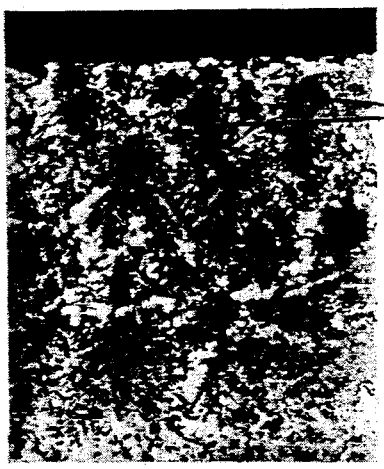

As outlined above with reference to patent specification 536976, segregation of any primary Si particles can have a very severe, adverse effect on mechanical properties. In alloys according to that specification, particularly in more complex castings featuring varying section thicknesses in which solidification conditions are difficult to control, large primary Si particles can form during solidification and these often float up and become caught under "ledges" in the mould or otherwise segregated. Such segregation is illustrated in FIGS. 8(*a*) and (*b*), respectively ×13 and ×60, for a 3HA alloy according to patent 536976 containing 0.05% Sr. As shown in FIGS. 8(*a*) and (*b*), primary Si has floated during solidification, and concentrated beneath a "ledge" in the casting.

The present invention provides a chemical method for widening the range of necessary solidification conditions and controlling microstructure, thereby eliminating the need for such stringent control over solidification conditions. Specifically Sr at a level in excess of 0.1% with Ti in excess of 0.005% is used in a novel manner to ensure formation of substantially fully eutectic microstructures.

In the present invention, the addition of high levels of Sr, such as from 0.11% to 0.4%, has been found to have beneficial effects on the structure of Al-(12-15%) Si alloys. At levels in excess of 0.3%, in particular, Sr has the effect of preventing the flotation and reducing the number, but not eliminating, primary Si particles formed during solidification; this resulting in a uniform dispersion of relatively coarse Si particles throughout the casting. This is illustrated in the photomicrograph (×50) of FIG. 9(*a*), for a 3HA type of alloy containing 0.3% Sr, and no Ti additions. The use of a higher level of Sr according to the invention has prevented flotation and reduced the number of the primary Si particles; those particles being relatively coarse, but evenly distributed through a substantially fully eutectic matrix. However, as shown more clearly in the photomicrograph (×200) of FIG. 9(*b*), the same structure also features Sr intermetallics in platelet form.

Figure 10:
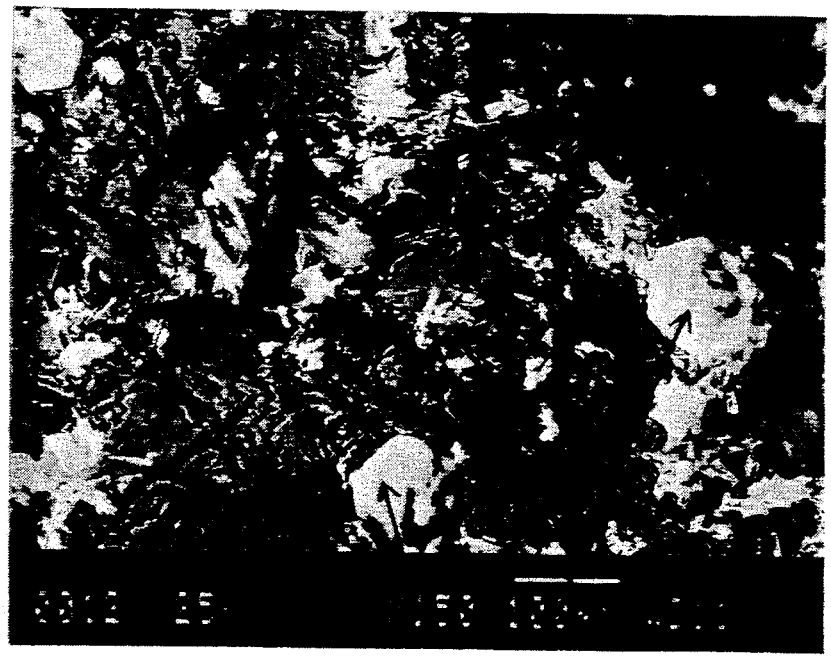
FIG. 10 is a scanning electron photomicrograph of the surface of a fractured casting according to the present invention.
Figure 11:
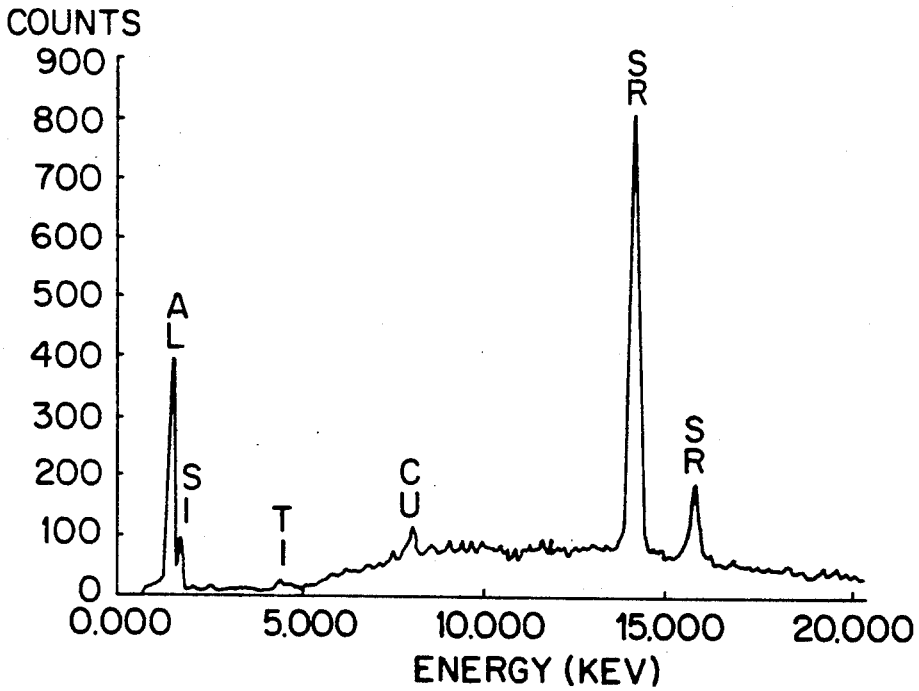
FIG. 11 is an x-ray analysis of the casting of FIG. 10.
Figure 19:
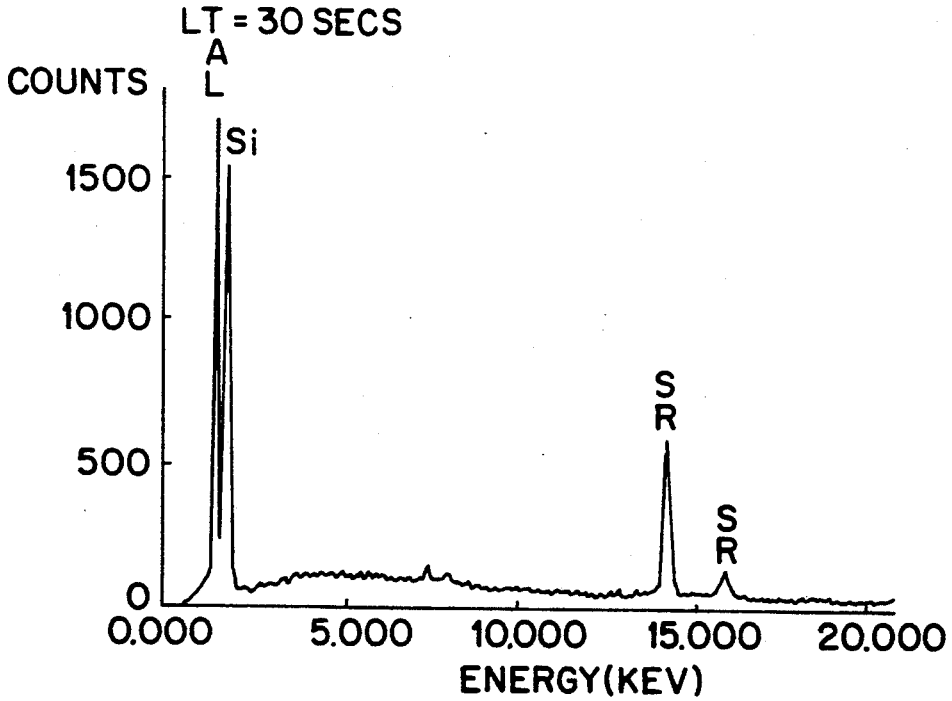
FIG. 19 is an x-ray analysis of the casting of FIG. 17.

The scanning electron photomicrograph (×150) of FIG. 10 and the x-ray analysis of FIG. 1 is taken on a fracture surface of the same alloy as shown in FIG. 9(*a*) and (*b*). The photomicrograph of FIG. 10 shows the Sr intermetallic platelets in the fracture surfaces, while the x-ray spectrum shows those particles to consist mainly of Al, Si and Sr.

Figure 12:
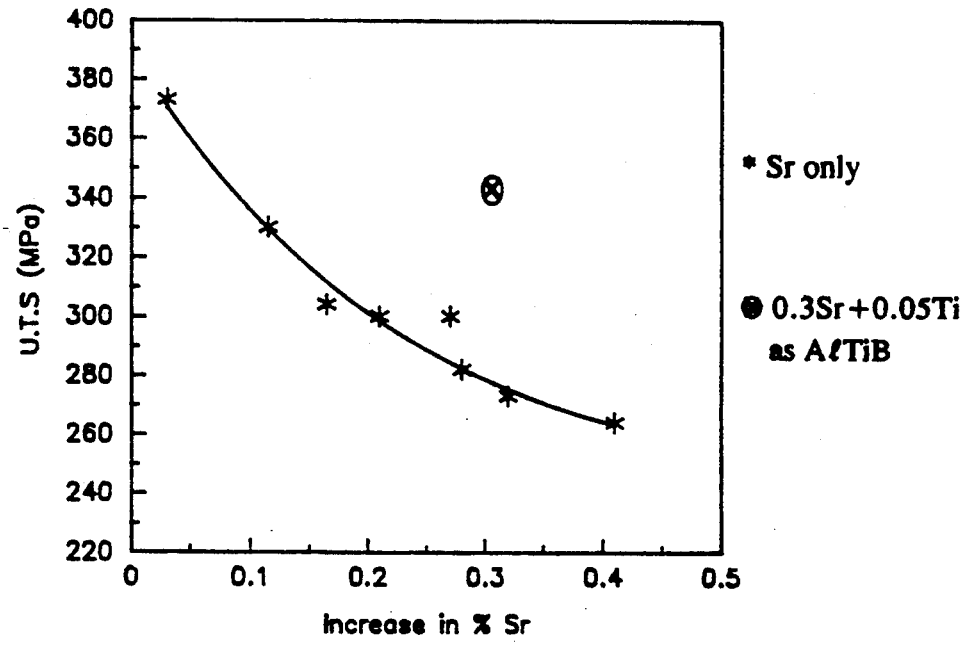
FIG. 12 is a graph of tensile strength versus Sr content in 3HA base alloy, with one point (average of multiple tests) for an alloy according to the present invention.

FIG. 12 shows the effect of increasing Sr content in a 3HA type alloy from the conventional level below 0.1%, through the range of up to 0.4% required by the present invention. Tensile strength falls progressively from about 370 MPa to about 265 MPa over those ranges, due to the detrimental effect of the increasing content of Sr intermetallic compounds in the form of platelets. However, this adverse effect is, as previously described, accompanied by the beneficial effect of achieving a uniform dispersion of primary Si, with this beneficial effect providing a significant improvement for the purpose of many applications. That is, use of Sr at a level in excess of 0.10, up to 0.4%, is not a solution to all problems for all applications, but it does provide the significant benefit of reducing the number and preventing flotation of primary Si, with the expected beneficial consequences in terms of machinability.

The tensile strength curve of FIG. 12 is drawn through asterisk points for alloy substantially free of Ti. However, also shown in FIG. 12 is a point, shown by a circle, which is the average of multiple tests. That point is for 0.30% Sr, in combination with 0.05%Ti added as Al-5%Ti-1% B, according to a preferred form of the invention. The point illustrates the beneficial effect of the addition of Ti, in combination with the higher level of Sr, in further reducing the amount of primary Si and, in particular, in changing the morphology of the Sr intermetallic particles and preventing their formation as platelets and hence achieving restoration of tensile strength. The Ti addition illustrated can be $(Al,Ti)B_2$, $TiB_2$, $TiAl_3$, or a similar compound. A similar effect also is achieved by the addition of Ti solely as $TiB_2$, $TiAl_3$ or in other forms as detailed herein, while such effect is not achieved with B in the absence of Ti. While only a single point is shown in FIG. 9, the benefits illustrated by this are found to be achieved by Ti in excess of 0.005% in combination with Sr at other higher levels required by the invention.

In Al-(12-15%) Si alloys, the combination of specific levels of Ti with Sr in excess of 0.10%, has been found to have beneficial effects on the microstructure of castings, especially those of complex geometry. The benefits of this preferred aspect of the invention are illustrated in FIGS. 13-16. The photomicrographs (×20) of FIG. 10 illustrate typical improved structures obtained in a complex finned cylinder cast in a zircon sand mould from an alloy according to the present invention with 0.3% Sr and 0.03% Ti added as Al-Ti-B. The component depicted in FIG. 13 was cast under conditions of low G (about 3° C./cm) and low (about 25 microns/sec) from a melt, poured at 760° C., of the following composition:

| | |
|---|---|
| Si | 13.7% |
| Sr | 0.30% |
| Ti | 0.03% (as $TiB_2$, $TiAl_3$) |
| Cu | 2.0% |
| Ni | 2.0% |
| Mg | 0.66% |
| Fe | 0.24% |
| Mn | 0.38% |
| Zr | 0.04% |

with each of Z, Sn, Pb, Cr, Ti (elemental, Na and B (other than as $TiB_2$) being less than 0.02% each, and Ca and P each less than 0.003%, the balance comprising Al apart from incidental impurities.

Figure 13A:
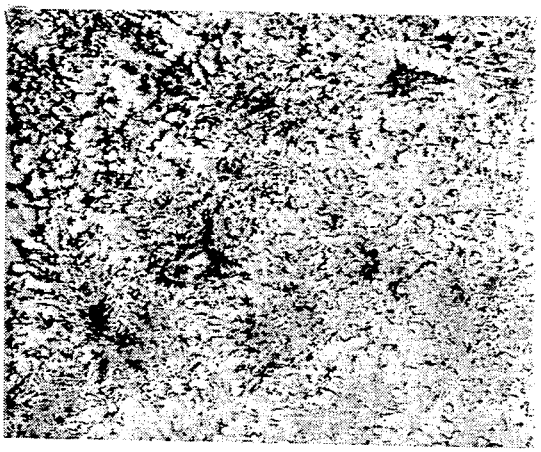
FIGS. 13(*a*) and (*b*) are photomicrographs showing microstructures of castings according to the present invention.
Figure 13B:
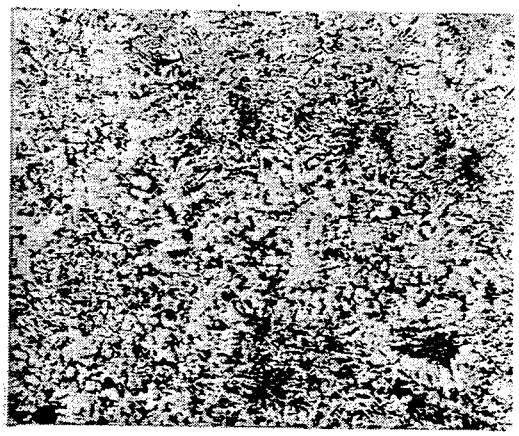
Figure 14:
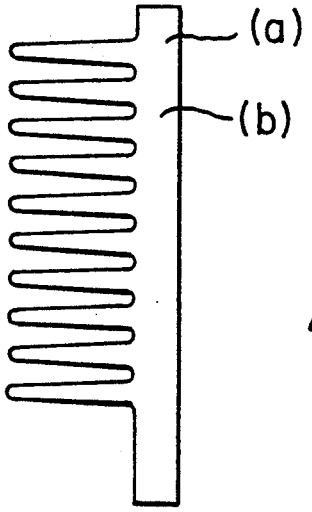
FIG. 14 is a schematic representation of a sectional view through the wall of a casting from which the photomicrograph of FIGS. 13(*a*) and (*b*) were taken.
Figure 16:
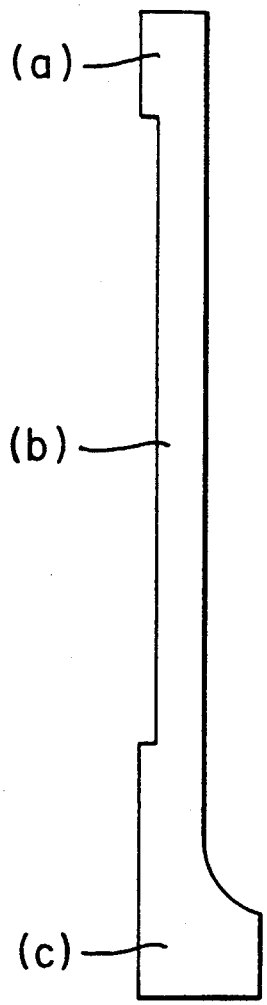
FIG. 16 is a schematic representation of a sectional view through the wall of a casting from which the photomicrograph of FIGS. 15(*a*), (*b*) and (*c*) were taken.

The representation of FIG. 14 and designations (a) and (b) thereof have the same relevance as in FIG. 3. The photomicrographs of FIG. 13 should be compared with those of FIG. 2. The structures of FIG. 2 exhibits large primary Si particles. However in contrast, the structure of the casting depicted in FIG. 13 is not only essentially free from primary Si but also does not feature the Sr intermetallic compound in platelet form. Instead the Sr intermetallic is present as equiaxed, blocky particles. Furthermore, it is evident that the Ti is necessary to achieve these changes in structure. This effect of Ti on primary Si and Sr intermetallic particles is quite new and unexpected and has not been reported before to the best of our knowledge.

Figure 15A:
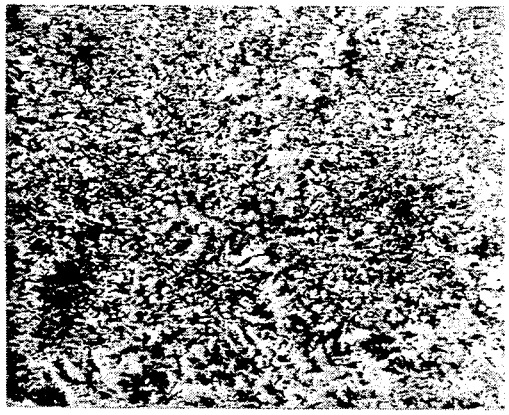
FIGS. 15(*a*) and (*b*) are further photomicrographs showing microstructures of castings according to the present invention.
Figure 15B:
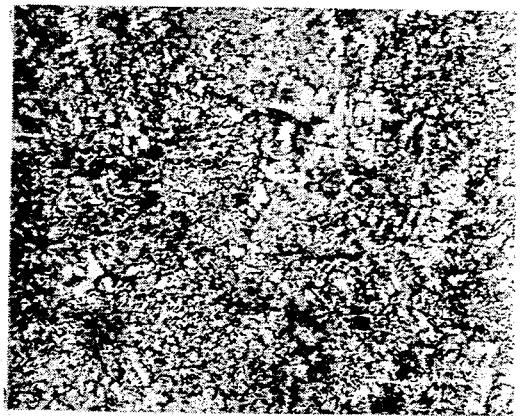
Figure 15C:
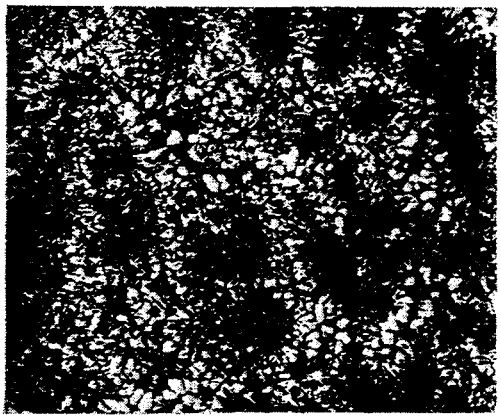

FIG. 15 further illustrates the significantly enhanced utility resulting from the use of Sr in combination with Ti according to the present invention. The typical photomicrographs (×20) of FIG. 15 illustrate the structure in an engine block cast in a zircon sand mould from an alloy according to the invention having 0.30% Sr and 0.04% Ti added as Al-Ti-B, but otherwise the same as the alloy of FIG. 4. The alloy depicted in FIG. 15 was cast under conditions of low G (about 3° C./cm) and low R (about 10 to 30 microns/sec) from a melt, poured at 780° C., of the following composition:

| | |
|---|---|
| Si | 13.6% |
| Sr | 0.30% |
| Ti | 0.04% (as $TiB_2$ and $TiAl_3$) |
| Cu | 2.0% |
| Ni | 2.1% |
| Mg | 0.64% |
| Fe | 0.22% |
| Mn | 0.4% |
| Zr | 0.05% |

with each of Zn, Sn, Pb, Cr, Ti (elemental), Na and B (other than as $TiB_2$) being less than 0.02% each, Ca and P each being less than 0.003% each, and the balance being Al apart from the incidental impurities.

The representation adjacent to the photomicrographs of FIG. 15 and the designations (a) to (c) thereof have the same relevance as in FIG. 4. The structures in FIG. 4 exhibit large, primary Si particles, while those of FIG. 15 are substantially free of such particles and have Sr intermetallic particles present as equiaxed, blocky particles.

Figure 17A:
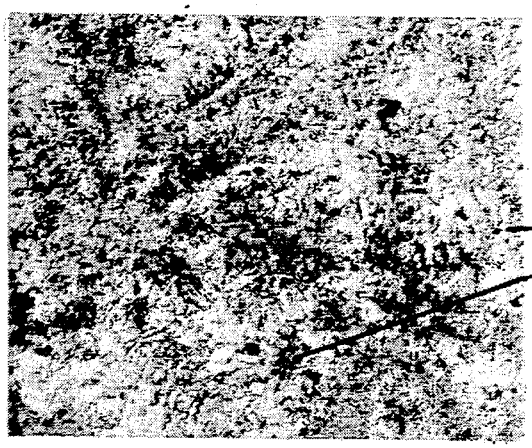
FIGS. 17(*a*) and (*b*) are further photomicrographs of an alloy according to the present invention.
Figure 17B:
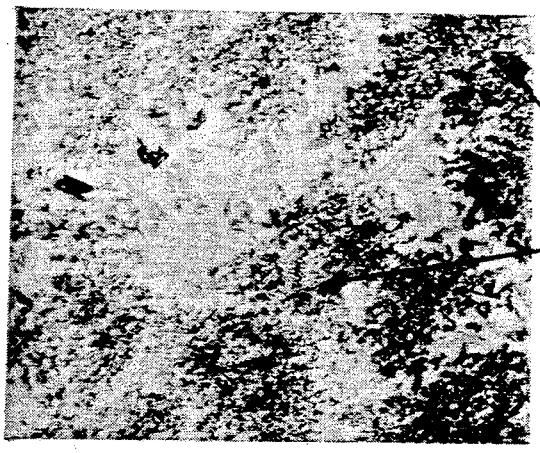
Figure 18:
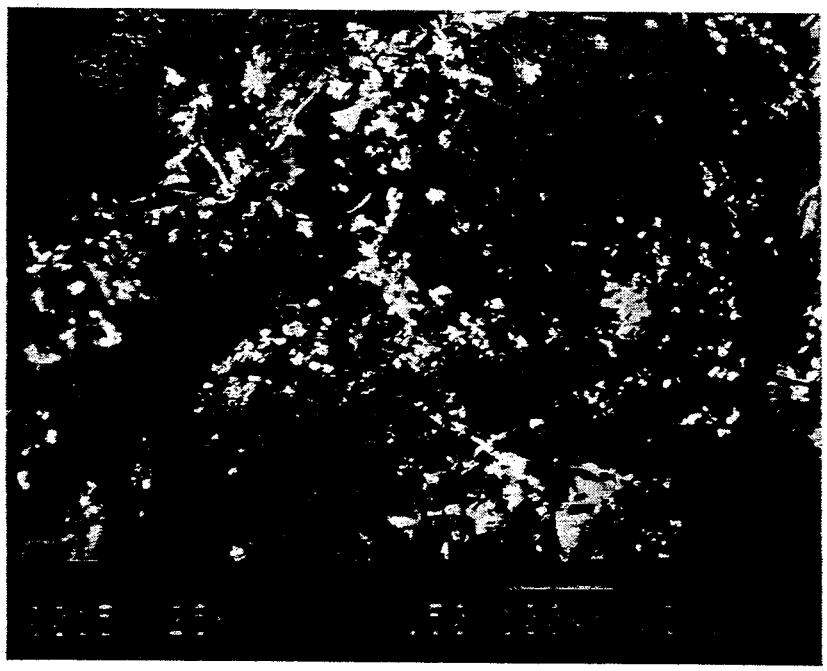
FIG. 18 is a scanning electro photomicrograph of the fracture surface of a casting of the alloy of FIGS. 17(*a*) and (*b*)

The photomicrographs (a) and (b) of FIG. 17, respectively ×50 and ×200, show the structure of a cast 3HA type of alloy having 0.30% Sr and 0.05% Ti added as Al-Ti-B. Again, the structure is characterised by equiaxed, blocky Sr intermetallic particles. The alloy of FIG. 17 is further illustrated in the scanning electron micrograph (×150) of FIG. 18 taken on a fracture surface of the casting. This micrograph highlights the changed morphology of the Sr intermetallics.

The use of novel combinations of Sr with Ti, for example as at least one of $(Al,Ti)B_2$, $TiB_2$ and $TiAl_3$ or similar forms, produces the unique, predominantly eutectic microstructures specified in patent 536976, but in a wide range of castings and without the need for sophisticated solidification controls. A further important consequence of using such combinations is the restoration of strength Properties as is evident from FIG. 12.

Figure 20:
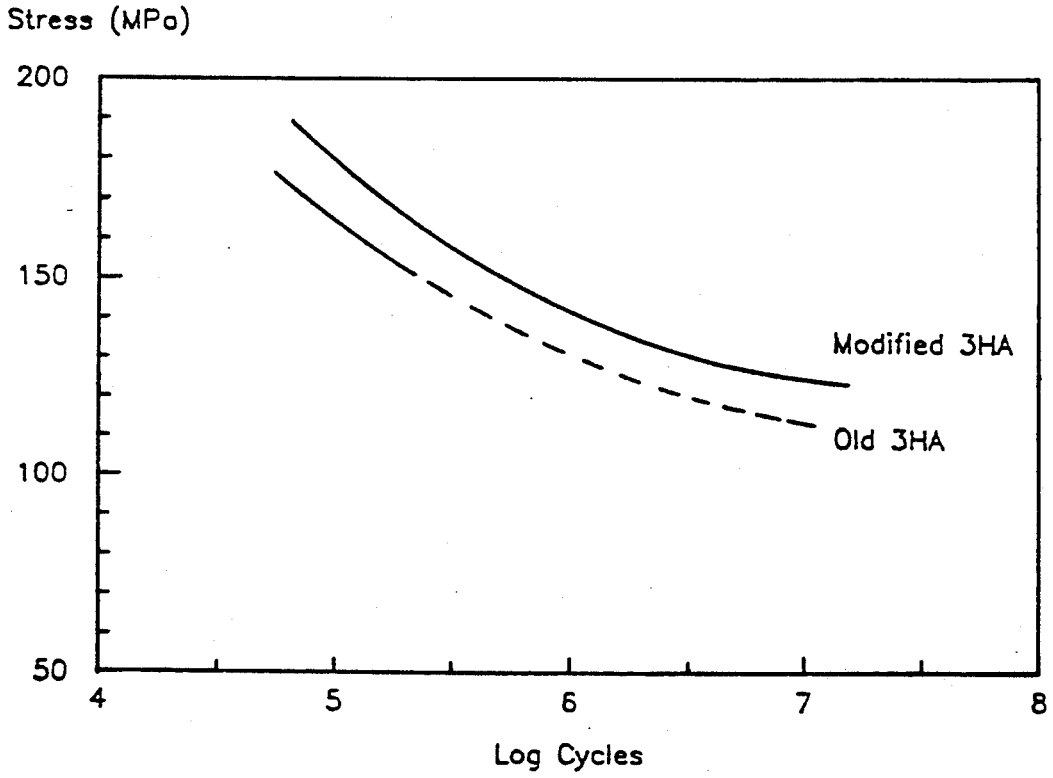
FIG. 20 is a graph showing respective S-N curves for HA alloy according to patent 536976 and the present invention.

In addition to substantial restoration of tensile strength, fatigue strength is found to be enhanced. FIG. 20 illustrates S-N curves for 3HA alloy having less than 0.10% Sr (indicated as "old 3HA") and for a 3HA type alloy having a combination of Sr and Ti in accordance with the present invention (indicated as "modified 3HA"). The alloy according to the invention, as is evident from FIG. 20, displays substantially higher fatigue strength than the "old 3HA". In the curve for "modified 3HA", Ti is added as Al-Ti-B, providing $(Al,Ti)B_2$, $TiB_2$ and $TiAl_3$ to the melt, although essentially the same result is obtained with $(Al,Ti)B_2$, $TiB_2$, or $TiAl_3$ alone or with other forms of Ti detailed herein.

Figure 21:
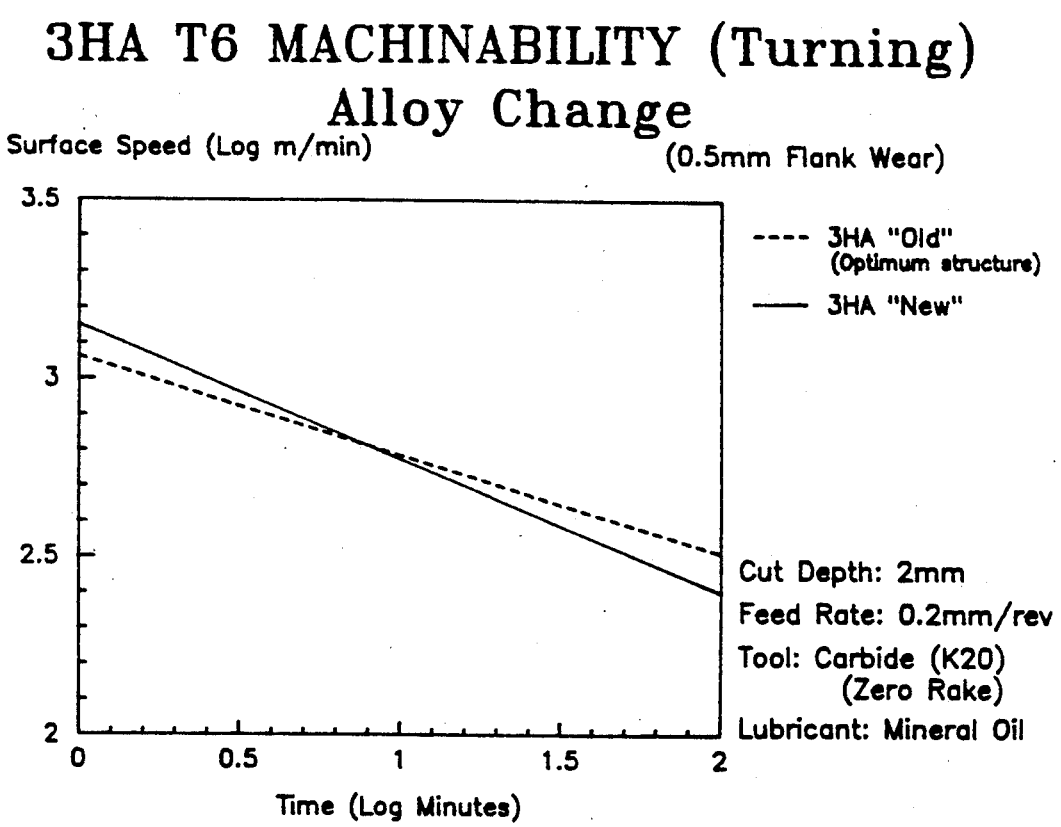
FIG. 21 is a graph showing respective machinability curves for 3HA alloy according to patent 536976 and the present invention.

FIG. 15 shows machinability for similarly designated "old 3HA" and "modified 3HA" in terms of tool life; the "old 3HA" being one with optimum structure as shown in FIG. 1. As is evident from FIG. 15, machinability is essentially the same for each alloy, a very similar tool life being achieved with each at any given cutting speed. The machinability of the "modified 3HA" is therefore very much better than for "old 3HA" which comprises areas of typical poor structure containing primary si, as is evident from a comparison of FIGS. 6 and 21.

The ability to retain good machinability of the "modified 3HA" according to the present invention is surprising, considering that this alloy contains a greater number of hard intermetallic particles than "old 3HA" when the latter has good structure. However, this is attributed to the fineness of the intermetallic particles in the alloy according to the invention, and to their uniform distribution in the structure. Again, in the "modified 3HA", Ti is added as Al-Ti-B, providing $(Al,Ti)B_2$, $TiB_2$ and $TiAl_3$, but essentially the same result is produced with any of $(Al,Ti)B_2$, $TiB_2$ and $TiAl_3$ alone or with other forms of Ti detailed herein.

The beneficial effects of Sr characterising the present invention is believed to be unique to Sr. This can be illustrated in part by reference to Na which, as is well known, acts similarly to Sr as a modifier in Al-Si alloys at conventional levels for Na and Sr. Thus, in that conventional context Na at a level of about 0.003% in 3HA alloy acts as a modifier and achieves similar modification to the use of about 0.05% Sr in such alloy. However, increasing the level of Na by approximately 10 times, as typically is done with Sr in the present invention, simply results in over modification of the alloys.

Figure 22:
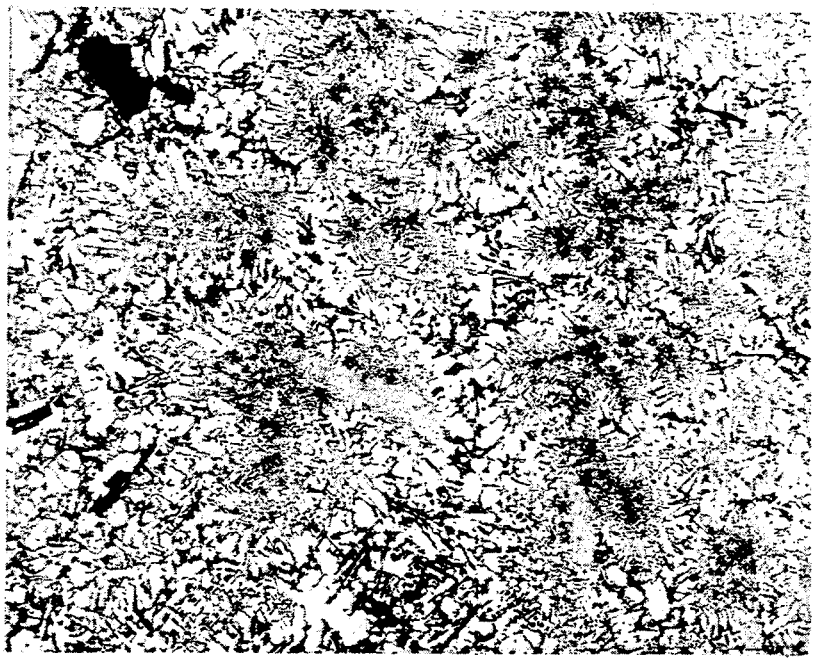
FIGS. 22(*a*) and (*b*) are respective photomicrographs showing microstructures of 3HA alloy having Na as modifier respectively at conventional levels and at a higher level.
Figure 22:
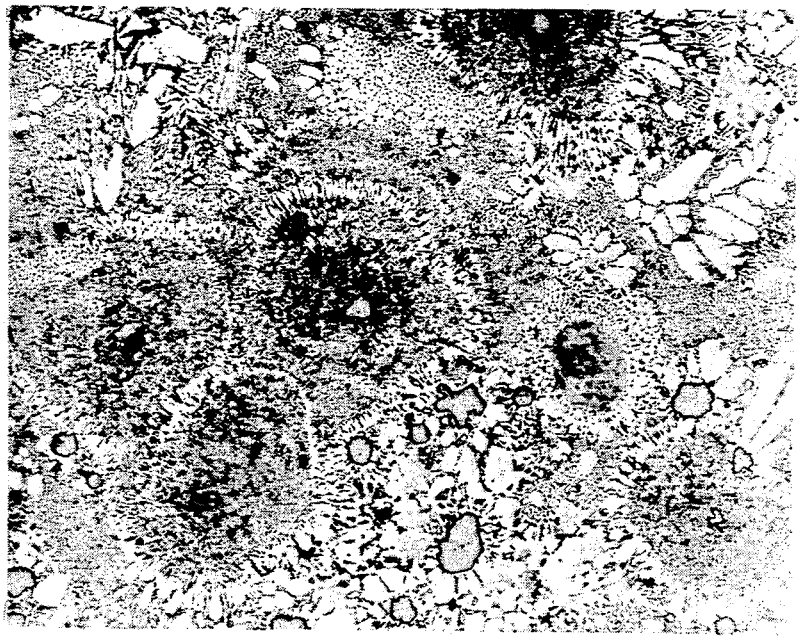

The photomicrograph (×50) of FIG. 22(*a*) shows the structure of a sand mould cast solid cylinder of a 3HA alloy having 0.003% Na, but without addition of Sr. This structure is of conventional modified form, and is similar to that obtained with the same alloy having 0.05% Sr without addition of Na see FIG. 1. The photomicrograph (×50) of FIG. 22(*b*) shows the structure of a casting identical to that of FIG. 22(*a*), but using an alloy differing only in that the Na level is increased to 0.05%. FIG. 22(*b*) shows an irregular, over modified structure featuring coarse alpha-aluminium regions between eutectic cells which would lead to rapid crack propagation as reported in patent specification 536976. Furthermore, the degree of primary Si particle flotation was found not to be affected by the level of Na additions. All castings made with alloys having Na at least 10 times the conventional level showed bands of floating primary Si at the top of the castings. Also, unlike castings according to the invention using Sr in combination with Ti, castings using such high levels of Na in combination with Ti did not show any reduction in the concentration of floating primary Si.

The key feature of the current invention is the improvement in structure, achieved by the combined effects of Sr and Ti in which Ti is preferably added as at least one of $(Al,Ti)B_2$, $TiB_2$ and $TiAl_3$ and most preferably achieved by the combined effects of Sr and Ti added as $TiB_2$. The mechanism by which these elements control the structure is understood to a degree sufficient to indicate the influence of Sr and Ti in a range of Al-(12–15%)Si alloy castings. However, the mechanisms are not sufficiently well understood to enable a full explanation at this stage. What is clear is that adding Sr to modify eutectic Si and/or to widen the coupled zone is known for Sr levels below 0.1%. What was not known prior to the present invention, and could not have been Predicted, was that levels of Sr in excess of 0.1%, such as from 0.11%, did not widen the coupled zone enough, to eliminate the primary Si, but instead stopped flotation of such primary Si particles as are able to form. Moreover, while Ti as $TiB_2$ or $TiAl_3$ is known to nucleate primary aluminium, it was totally unexpected that it would further reduce the amount of primary Si present and change the morphology of Sr intermetallic particles from platelets to substantially equiaxed blocky particles. In the latter regard, it may have been predicted that the addition of Ti would simply nucleate finer platelike Sr particles but this is not the case.

Figure 23:
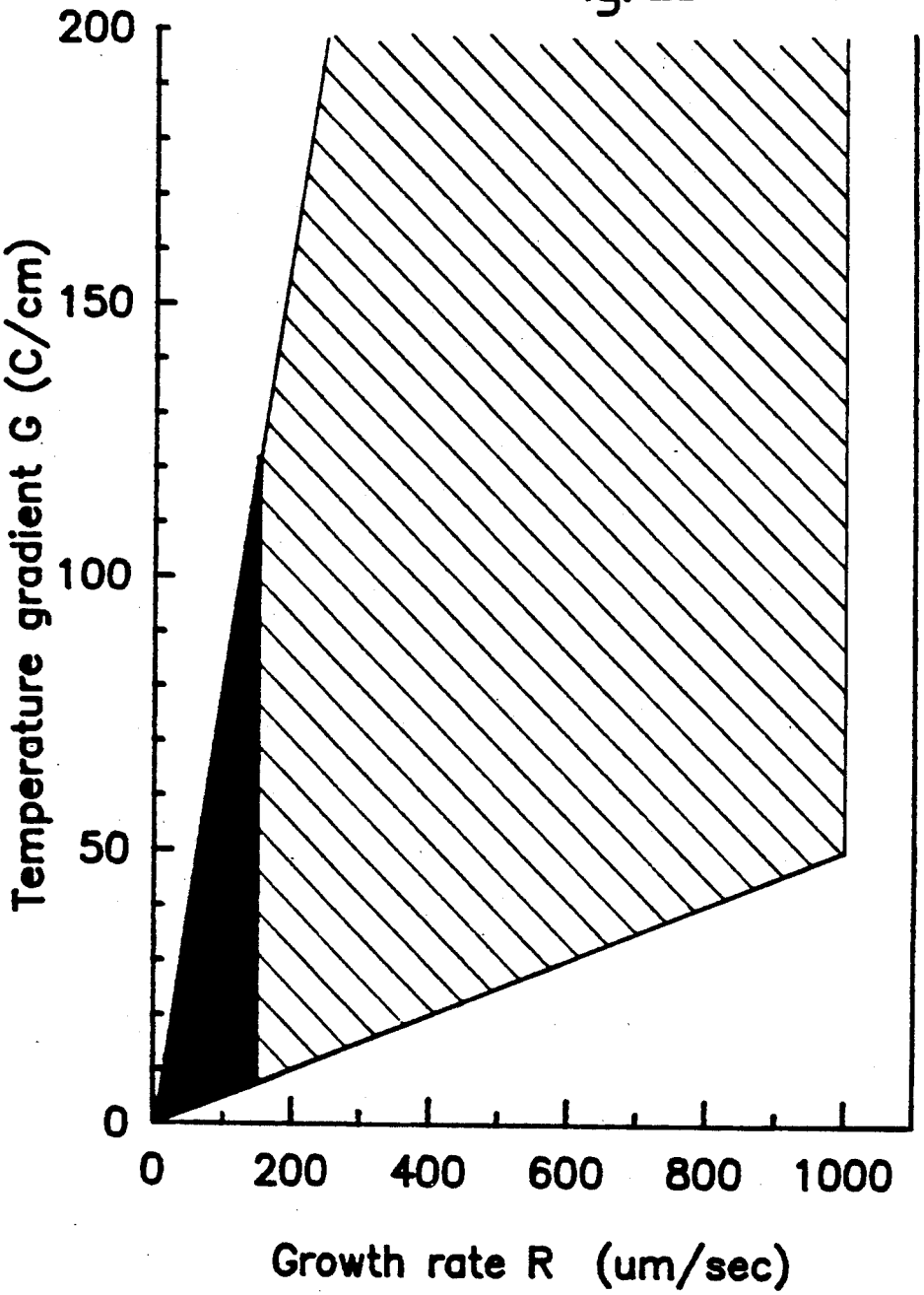
FIG. 23 is a diagram showing part of the relationship between G and R for 3HA according to specification 536976 and, with the addition of Sr and Ti, according to the present invention.

An appreciation of the improvement provided by the invention can be gained from FIG. 23. In FIG. 23, the window of casting conditions in terms of G and R are depicted, based on the data available. As indicated, the shaded area designates part of those conditions applicable to old 3HA according to patent 536976, while the black area designates the extension of conditions applicable to the alloy of the invention. This shows a lowering of the G and R values for which modified eutectic microstructures are achieved. The expansion of that window is shown to provide a minimum R value of approximately 15 microns/sec, with the minimum G value reduced to close to zero. While the expanded area is small, it is in the critical area of the window in terms of castability required for alloys cast on a production basis in permanent and sand moulds. That is, the G and R values obtainable with the alloys of the invention cover the solidification conditions existing in sand castings in which the G value typically is less than 5° C./cm and the R value is estimated to be as low as 15 microns/-sec, depending on the section thickness of the cast product.

Based on the effects of Sr and Ti additions described in the present specification, an alloy composition can now be defined which displays all of the characteristics of the alloys defined in patent 536976 but, in addition, now features the improvement that it can be used in a much wider variety of castings without the inevitable need for sophisticated solidification controls.

The alloy of the invention is well suited for repetitive casting on a production basis, using permanent and sand moulds. It enables a wide variety of castings to be Produced on that basis in such moulds, including castings of complex form and of substantial wall section thickness up to 30 mm and higher. The alloy of the invention is extremely useful in the production of castings in which there is a need for good wear resistance and machinability, high levels of fatigue strength and good ambient and elevated temperature properties such as hardness and tensile strength. These castings include cylinder blocks, cylinder heads (without the need for traditional valve guide and inlet valve seat inserts), transmission and brake components and other engine components such as pistons and rocker arms. Non-automotive or stationary engine applications include door restraint/closure cylinders, moulds for products such as tires and tiles, pistons and cylinders for compressors, and housings for pumps such as slurry pumps.

It will be clearly understood that the invention in its general aspects is not limited to the specific details referred to hereinabove.

The claims defining the invention are as follows:

1. A method of producing a casting of a hypereutectic Al-Si alloy have 12–15% Si, comprising:

(a) providing a melt of the alloy with Sr present at a level of from 0.11% to 0.4% and Ti present at a level of from 0.005% to 0.25% provided that if Ti is provided as $(Al,Ti)B_2$ or $TiB_2$ or mixtures thereof Ti is present at a level not in excess of 0.1%, the melt further comprising

| | |
|---|---|
| Cu | 1.5 to 5.5% |
| Ni | 1.0 to 3.0% |
| Mg | 0.1 to 1.0% |
| Fe | 0.1 to 1.0% |
| Mn | 0.1 to 0.8% |
| Zr | 0.01 to 0.1% |
| Zn | 0 to 3.0% |
| Sn | 0 to 0.2% |
| Pb | 0 to 0.2% |
| Cr | 0 to 0.1% |
| Na | 0 to 0.01% |
| B (elemental) | 0.05% maximum |
| Ca | 0.003% maximum |
| P | 0.003% maximum |
| Others | 0.05% maximum each, |

the balance, apart from incidental impurities, being Al; and (b) casting the melt in a mould substantially without melt loss of Sr to form the casting; the level of Sr and Ti being appropriate for solidification conditions experienced in terms of mould type and the complexity of the casting, such that the melt has improved castability resulting in a microstructure in which any primary Si present is substantially uniformly dispersed and is substantially free of segregation, and in which substantially uniformly dispersed Sr intermetallic particles are present but are substantially free of such particles in the form of platelets, the microstructure predominantly comprising a eutectic matrix.

2. A method according to claim 1, wherein Sr is provided to a level of from 0.18% to 0.4%.

3. A method according to claim 1, wherein Sr is provided at from 0.25% to 0.35%.

4. A method according to claim 1 wherein the level of Sr and Ti is such that said microstructure is substantially free of primary Si particles.

5. A method according to claim 1, wherein Ti is provided is at least one of $(Al,Ti)B_2$, $TiB_2$, $TiAl_3$, TiC and TiN.

6. A method according to claim 5, wherein Ti is provided to a level of from 0.01% to 0.06%.

7. A method according to claim 6, wherein Ti is provided at from 0.02% to 0.06%.

8. A method according to claim 7, wherein Ti is provided at from 0.03% to 0.05%.

9. A method according to claim 1 wherein Ti is provided as at least one of $(Al,Ti)B_2$ and $TiB_2$ and mixtures thereof.

10. A method according to claim 8, wherein Ti is provided as a mixture of $TiB_2$ and $TiAl_3$.

11. A method according to claim 1 wherein said Ti is added as an alloy selected from Al-Ti and Al-Ti-B master alloys.

12. A method according to claim 1, wherein said melt, in addition to Sr and Ti comprises:

| | |
|---|---|
| Cu | 1.5-5.5% |
| Ni | 1.0-3.0% |
| Mg | 0.1-1.0% |
| Fe | 0.1-1.0% |
| Mn | 0.1-0.8% |
| Zr | 0.01-0.1% |

the balance, apart from impurities, comprising Al.

13. A method according to claim 1 wherein said melt is cast in a permanent mould.

14. A method according to claim 1 wherein said melt is cast in a sand mould.

15. A method according to claim 1 wherein said melt is cast under solidification conditions providing a growth rate R of solid phase of less than 150 microns/sec and a temperature gradient G at the solid/liquid interface of less than 15° C./cm.

16. A method according to claim 15, wherein said solidification conditions are such that at least one of R and G achieves a value of about 15 microns/sec and 0° C./cm, respectively.

17. A method according to claim 13, wherein said melt is cast under solidification conditions providing a growth rate R of solid phase of less than about 25 microns/sec and a temperature gradient at the solid/liquid interface of less than about 3.0° C./cm.

18. A method according to claim 14, wherein said melt is cast under solidification conditions providing a growth rate R of solid phase of less than from about 10 to 30 microns/sec and a temperature gradient G at the solid/liquid interface of less than about 3.0° C./cm.

19. A cast hypereutectic Al-SI alloy with from 12-15% Si, the alloy having excellent wear resistance and machinability, improved fatigue strength and good levels of ambient and elevated temperature properties; wherein said alloy contains Sr in an amount of from 0.11 to 0.4% and Ti in an amount of from 0.005 to 0.25% provided that if Ti is provided as $(Al, Ti)B_2$ or $TiB_2$ or mixtures thereof Ti is present at a level not in excess of 0.1%, the alloy further comprising

| | |
|---|---|
| Cu | 1.5 to 5.5% |
| Ni | 1.0 to 3.00% |
| Mg | 0.1 to 1.0% |
| Fe | 0.1 to 1.0% |
| Mn | 0.1 to 0.8% |
| Zr | 0.01 to 0.1% |
| Zn | 0 to 3.0% |
| Sn | 0 to 0.2% |
| Pb | 0 to 0.2% |
| Cr | 0 to 0.1% |
| Na | 0 to 0.01% |
| B(elemental) | 0.05% maximum |
| Ca | 0.003% maximum |
| P | 0.003% maximum |
| Others | 0.05% maximum each, |

the balance, apart from incidental impurities, being Al; and the level of Sr and Ti is such that the alloy has a microstructure in which any primary Si formed is substantially uniformly dispersed and is substantially free of segregation, and in which substantially uniformly dispersed Sr intermetallic particles are present but are substantially free of such particles in the form of platelets, the microstructure predominantly comprising a eutectic matrix.

20. A cast alloy according to claim 19, wherein SXr is present at a level of from 0.18% to 0.4%.

21. A cast alloy according to claim 20, wherein Sr is present at from 0.25% to 0.35%.

22. A cast alloy according to claim 19, wherein said microstructure is substantially free of primary Si particles.

23. A cast alloy according to claim 20, wherein said Ti is present as at least one of $(Al,Ti)B_2$, $TiB_2$, $TiAl_3$, TiC and TiN.

24. A cast alloy according to claim 19, wherein Ti is present at a level of from 0.01% to 0.06%.

25. A cast alloy according to claim 24, wherein Ti is present at a level of from 0.02% to 0.06%.

26. A cast alloy according to claim 25, wherein Ti is present at a level of from 0.03% to 0.05%.

27. A cast alloy according to claim 19 wherein Ti is present as at least one of $(Al,Ti)B_2$, $TiB_2$ and mixtures thereof.

28. A cast alloy according to claim 27, wherein Ti is present as a mixture of $TiB_2$ and $TiAl_3$.

29. A cast alloy according to claim 19, wherein said alloy in addition to Sr and Ti comprises:

| | |
|---|---|
| Cu | 1.5-5.5% |
| Ni | 1.0-3.0% |
| Mg | 0.1-1.0% |
| Fe | 0.1-1.0% |
| Mn | 0.1-0.8% |
| Zr | 0.01-0.1% |

the balance, apart from impurities, comprising Al.

* * * * *